US005330247A

United States Patent [19]

Fricke

[11] Patent Number: 5,330,247

[45] Date of Patent: Jul. 19, 1994

[54] MONOLITHIC CAST PICNIC TABLE

[75] Inventor: Obed M. Fricke, Montezuma, Kans.

[73] Assignee: Kansas State University Research Foundation, Manhattan, Kans.

[21] Appl. No.: 33,237

[22] Filed: Mar. 16, 1993

[51] Int. Cl.[5] ..... A47C 5/02; A47B 83/02

[52] U.S. Cl. ..... 297/157; 297/232

[58] Field of Search ..... 297/135, 157, 170, 172, 297/174, 232, 245, 452.1, 463

[56] References Cited

U.S. PATENT DOCUMENTS

| | | | |
|---|---|---|---|
| 1,662,362 | 6/1932 | Mathis | 297/440.23 |
| 2,659,422 | 11/1953 | Holland | 297/440.20 X |
| 3,748,012 | 7/1973 | Abelman | 297/440.1 |
| 3,756,657 | 9/1973 | Johnson | 297/440.1 |

FOREIGN PATENT DOCUMENTS

| | | | |
|---|---|---|---|
| 2554332 | 5/1965 | France | 297/157 |

OTHER PUBLICATIONS

Wabash Valley Brochure re outdoor furniture and picnic tables.

*Primary Examiner*—Peter R. Brown

*Attorney, Agent, or Firm*—Hovey, Williams, Timmons & Collins

[57] ABSTRACT

An aesthetically pleasing, monolithic cast concrete picnic table (10) is provided which presents a generally horizontal table section (12), horizontal bench sections (14,16) generally along and below the side margins of the table section (12), and a central connecting section and base (18,20) joining the table and bench sections (12,14,16) and permitting placement of the table (10) on a support surface. Preferably, the table (10) presents a generally H-shaped footprint, with unobstructed spaces (117) beneath the bench sections (14,16) on either side of the connecting section (18). The table (10) can be rapidly cast using a form (118) permitting easy separation of the table (10) via jacks (126).

11 Claims, 3 Drawing Sheets

Fig. 1.
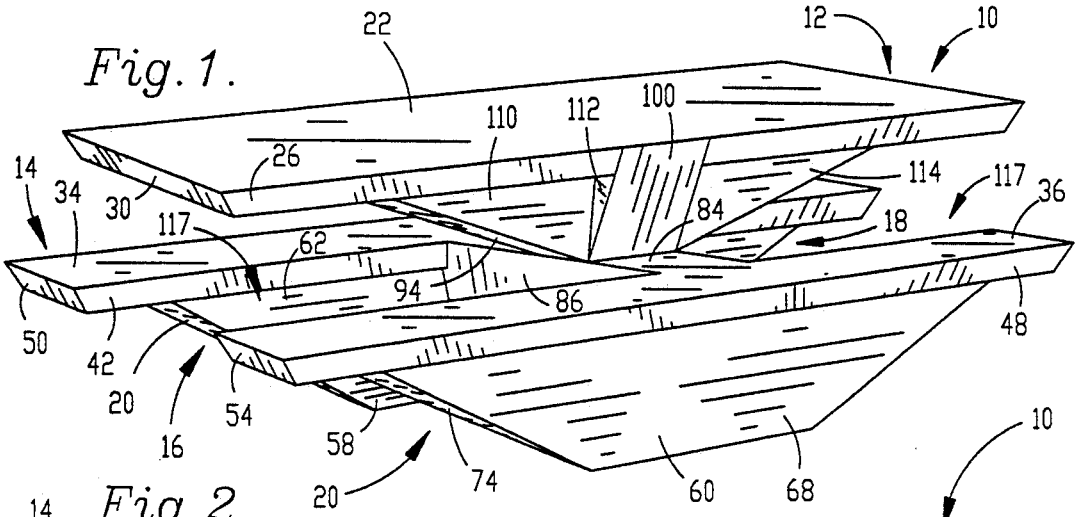
Fig. 2.
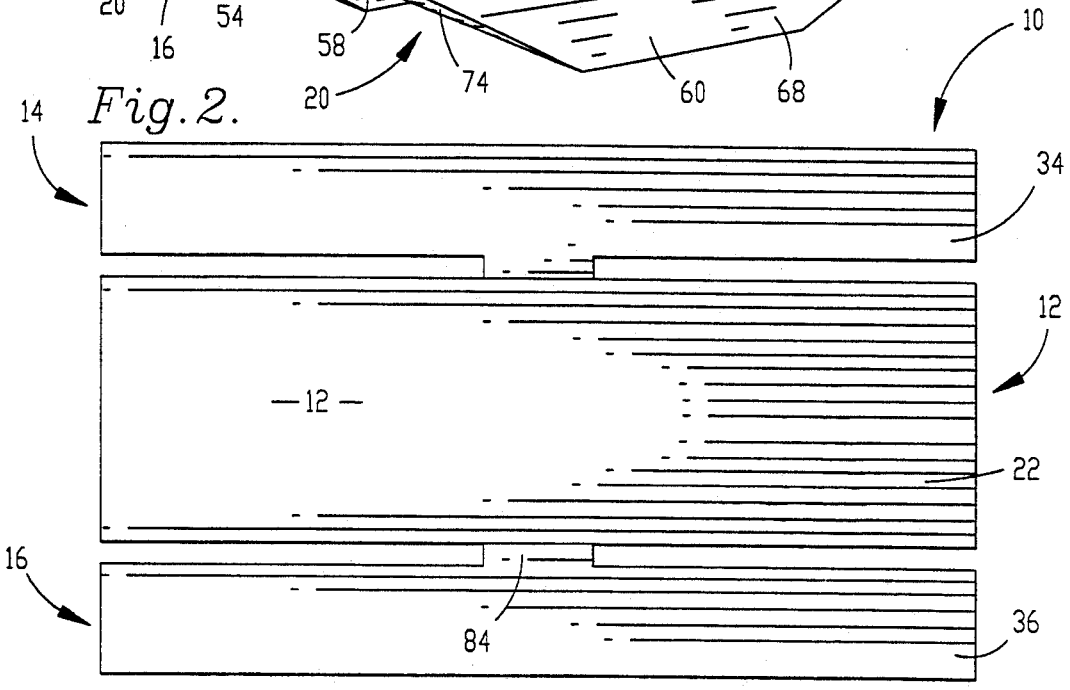
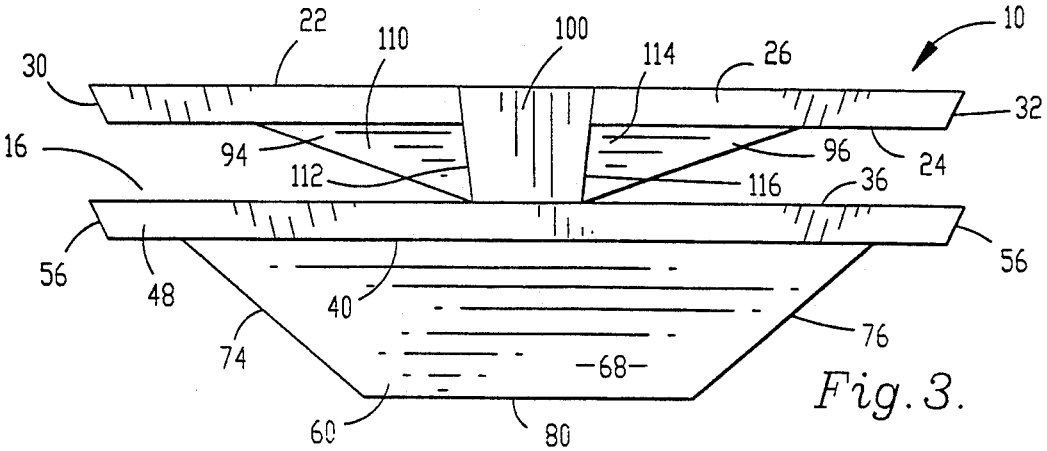
Fig. 3.

MONOLITHIC CAST PICNIC TABLE

BACKGROUND OF THE INVENTION

1. Field of the Invention

The present invention is broadly concerned with a unitary, monolithic, cast concrete picnic table especially designed for use in parks or other public places to minimize theft and vandalism. More particularly, the invention pertains to such a cast picnic table which includes a horizontal table section, a pair of bench sections, and a central connecting section permitting the table to be cast as a monolithic structure and moved to a use location as a unitary body.

2. Description of the Prior Art

Picnic tables designed for use in public places such as parks and lakes are subject to theft or destruction, and replacement or repair of such tables is a significant expense. One type of prior table is in the form of metal or synthetic resin table and bench sections interconnected with metallic tubular members. These tables are generally relatively lightweight, and therefore can be readily picked up and stolen.

It has also been known in the past to provide cast concrete picnic tables, but these are generally in the form of separate tables and benches which must be separately cast, moved to a use location, and secured in place. While such assemblies are difficult to steal owing to the weight thereof, their cost is considerable because of the separate casting and setup operations required. In addition, they are generally quite unattractive in appearance.

There is accordingly a need in the art for an improved, monolithic cast picnic table which can be fabricated, transported and set in place as a unitary body, while nevertheless exhibiting characteristics of weight, strength and durability allowing efficient use of the cast table in public venues.

SUMMARY OF THE INVENTION

The present invention overcomes the problems outlined above, and provides a unitary monolithic cast picnic table presenting a generally horizontal table section having a pair of opposed side margins, together with a generally horizontal bench section located generally along and below each of the table section side margins, and a central connecting section joining the table and bench sections. The overall table assembly further presents a base presenting placement of the table on a support surface.

In preferred forms, the table is formed of concrete and includes a transverse segment serving to interconnect the bench sections with an inclined wall table support section extending between the transverse connecting segment and the table section. Each of the bench sections includes an upright bench support segment depending therefrom, with free, unobstructed leg spaces being provided between and below the bench sections and on opposite sides of the central connecting section.

BRIEF DESCRIPTION OF THE DRAWINGS

FIG. 1 is an isometric view of the cast concrete picnic table in accordance with the invention;

FIG. 2 is a plan view of the table of FIG. 1;

FIG. 3 is a side elevational view of the picnic table of FIG. 1;

DETAILED DESCRIPTION OF THE PREFERRED EMBODIMENTS

Figure 4:
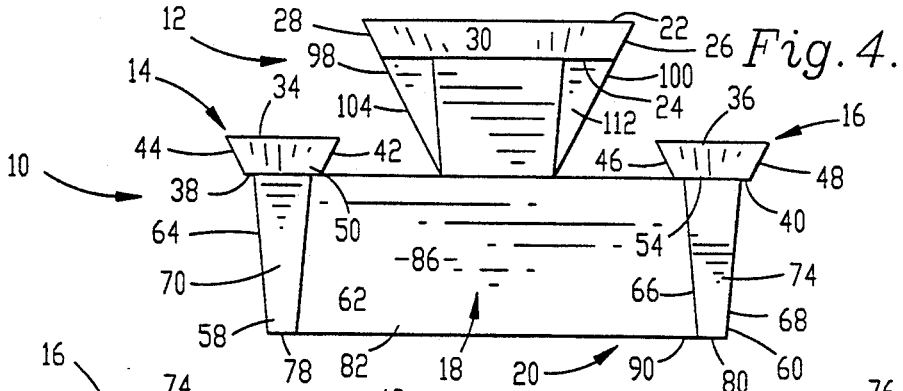
FIG. 4 is an end elevational view of the picnic table of FIG. 1.
Figure 5:
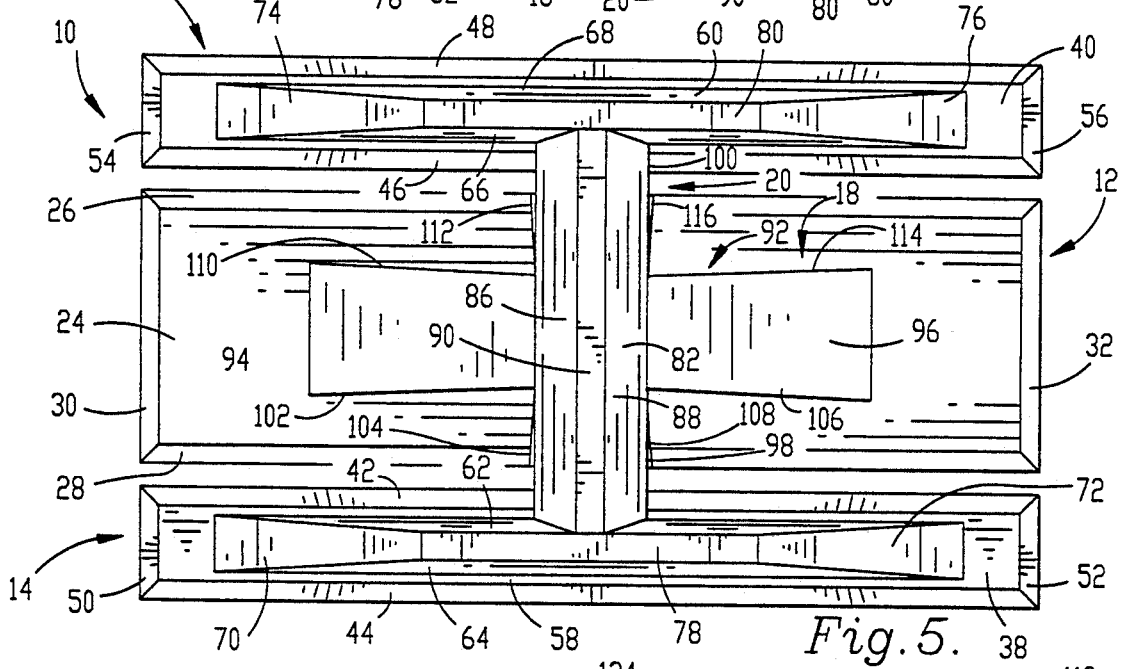
FIG. 5 is a bottom view of the picnic table of FIG. 1.

Turning now to the drawings, and particularly FIGS. 1–5, a monolithic cast picnic table 10 in accordance with the invention is illustrated. Broadly speaking, the table 10 includes an uppermost table section 12, a pair of elongated bench sections 14, 16 on opposite sides and below the table section 12, and a central connecting section 18 joining table section 12 and the bench sections 14, 16. Finally, base structure 20 is provided for permitting placement of the table 10 on a support surface.

In more detail, the table section 12 is generally rectangular in plan configuration, and presents an uppermost planar surface 22, a lower, generally planar underside 24, and tapered, circumscribing marginal walls including sidewalls 26, 28 and end walls 30, 32.

Each of the bench sections 14, 16 is likewise rectangular in plan configuration, and present planar upper surfaces 34, 36, opposed planar undersides 38, 40 and tapered, circumscribing marginal walls including sidewalls 42, 44 and 46, 48, and end walls 50, 52 and 54, 56. Each of the bench sections 14, 16 includes a depending, somewhat trapezoidally-shaped support segment 58, 60 extending from the corresponding underside 38, 40. The segments 58, 60 present a pair of converging sidewalls 62, 64 and 66, 68, as well as obliquely oriented end walls 70, 72 and 74, 76. The bottoms of the segments 58, 60 are in the form of flattened lowermost surfaces 78, 80.

Connecting section 18 includes a lower transverse segment 82 extending between and joining the support segments 58, 60. The segment 82 includes a planar top surface 84 at the same level of and extending inwardly from the surfaces 34, 36 of the bench sections 14, 16. In addition, this segment presents a pair of downwardly and inwardly converging end walls 86, 88 which terminate in a lowermost planar base surface 90.

The connecting section 18 further includes an elongated table support segment 92 extending above transverse segment 82 and orthogonally oriented relative to the latter. The segment 92 presents a pair of planar, tapered, diverging end walls 94, 96 extending upwardly from top surface 84 and merging with table section underside 24. In addition, the segment 92 has a pair of opposed, inclined, diverging sidewalls 98, 100 likewise extending upwardly from surface 84 and merging into the marginal sidewalls 26, 28 of the table section 12. Intersecting pairs of triangular wall portions 102, 104, 106, 108, 110, 112 and 114, 116 extend between the obliquely oriented end walls and sidewalls 94–100 as shown.

As will be readily understood from the foregoing discussion, the base structure 20 of the picnic table 10 includes the lowermost surfaces 78, 80 of the bench support segments 58, 60, as well as base surface 90 of transverse segment 82. These lowermost surfaces are essentially co-planar, thereby presenting a stable, somewhat H-shaped footprint for the table 10. Moreover, this configuration presents a pair of free, unobstructed spaces 117 between and below the bench sections 14, 16 and on opposite sides of the central connection section 18.

Figure 6:
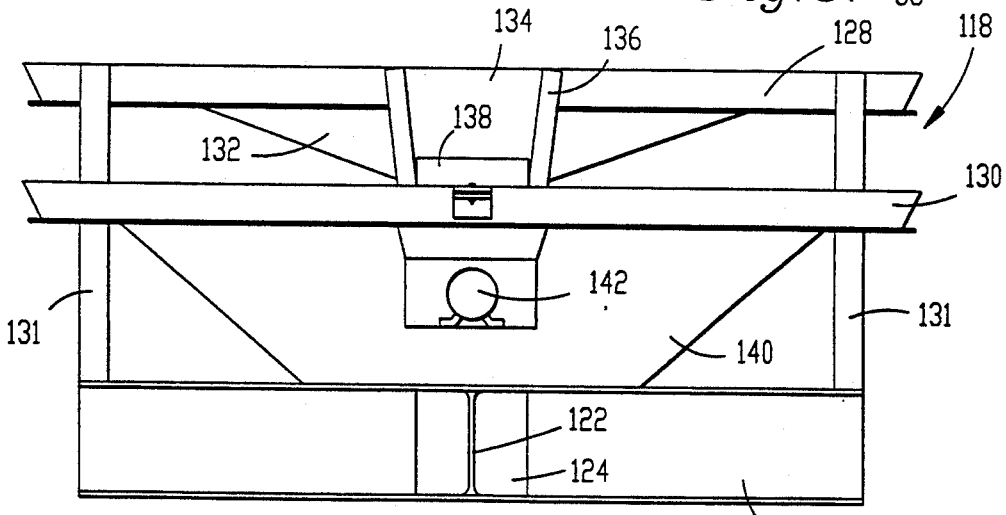
FIG. 6 is a side view of the preferred one-piece form used in casting the picnic table of FIG. 1.
Figure 8:
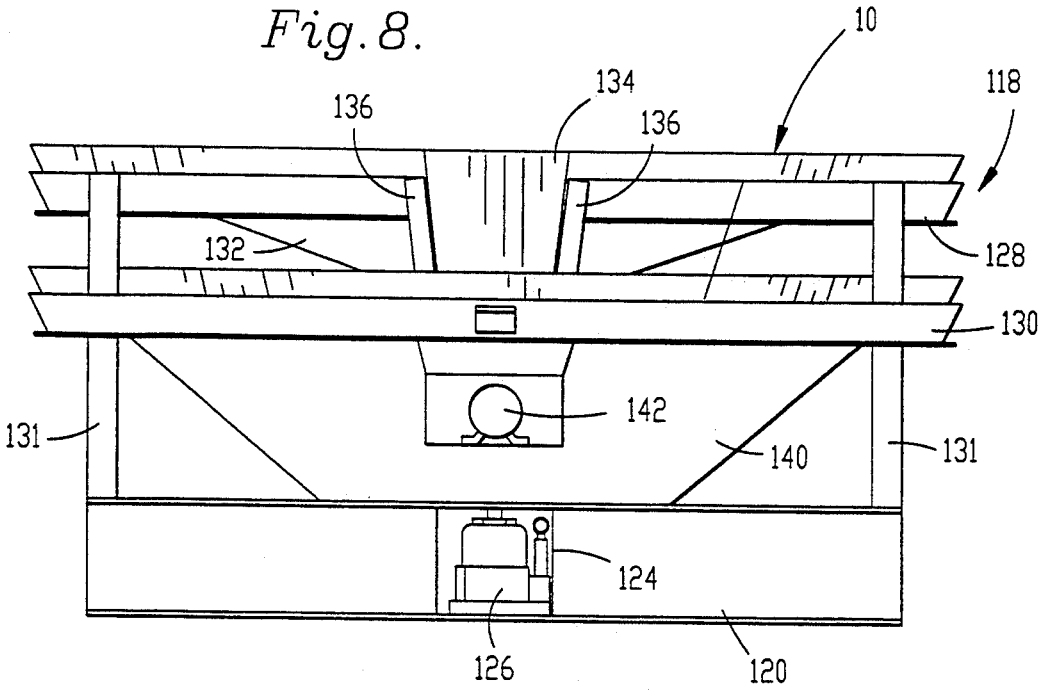
FIG. 8 is a side view of the form of FIGS. 6–7, and illustrating the use of the hydraulic jacks associated with the form for separating the completed cast picnic table from the form.
Figure 7:
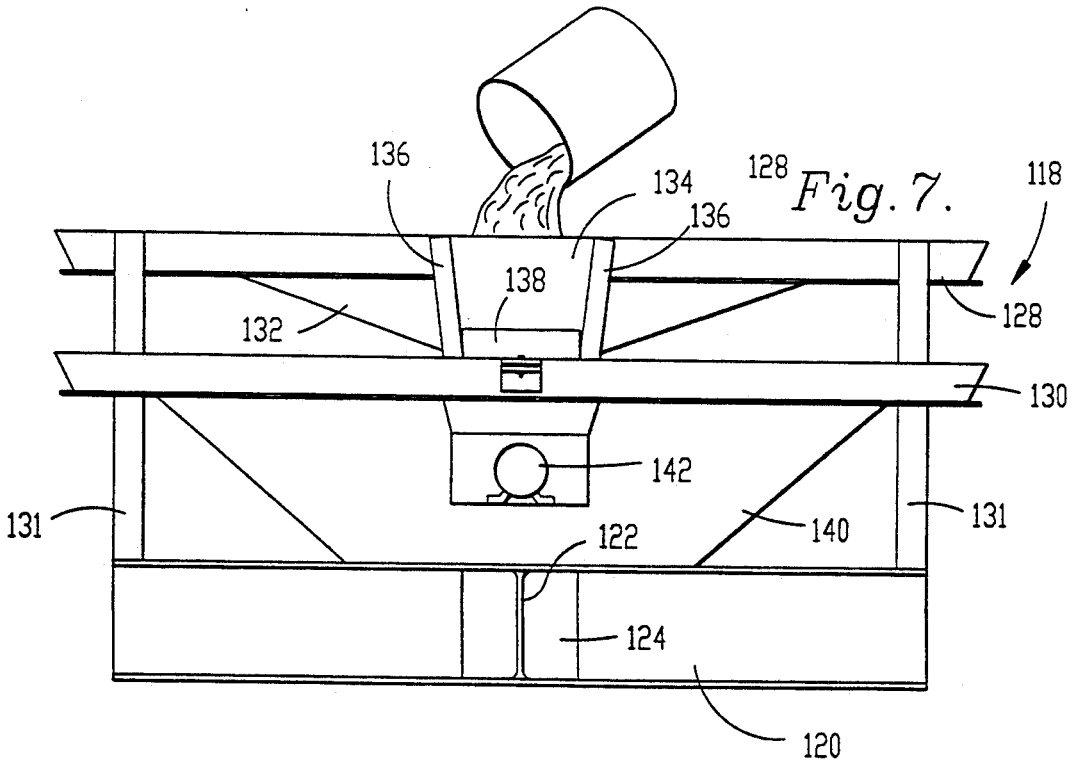
FIG. 7 is a view similar to that of FIG. 6, and showing fabrication of the picnic table by filling of the FIG. 6 form with concrete.

FIGS. 6–8 illustrate the preferred one-piece form 118 used in the fabrication of table 10. Form 118 includes a pair of laterally spaced apart base rails 120, with a transverse central I-beam 122 and end marginal transverse connectors (not shown). The respective base rails 120 include a central opening 124 therein for housing lifting jacks 126 used to separate the completed table 10 from the form 118.

The overall form 118 further includes a central, open top pan 128 for formation of the table section 12, together with a pair of open top pans 130 configured for forming the individual bench sections 14, 16. Upright struts 131 serve to support the pans 128, 130 in their individual positions. Tapered wall structure 132 in communication with pan 128, as well as a pair of detachable obliquely oriented marginal plates 134 supported by struts 136, are provided for the formation of central connecting section 18. A pair of central, horizontal hold down plates 138 are provided which extend from the base of marginal plates 134 outwardly to the outboard margin of each pan 130.

Each of the bench section pans 130 includes depending form structure 140 in communication with the associated pan 130 and configured for forming the individual support segments 58, 60. Additionally, transversely extended form walls (not shown) communicate with the structures 140 and the structure 132 to provide the base structure 20 for the table.

In use, the form 118 is initially configured as illustrated in FIG. 7, with the plates 134 and 138 in place. Given the unitary nature of the form, it is then only necessary to pour concrete into top pan 128 as shown in FIG. 7, so that concrete fills the entire form. If desired, metallic reinforcements may be positioned within the form 118 before pouring. In order to facilitate proper filling, a plurality of vibrators 142 secured to the frame at strategic locations may be used. When the poured concrete reaches the level to fill pans 130, the hold down plates 138 may be removed and the concrete in the pans 130 is finished. At the completion of the pour, the upper surface of the concrete within pan 128 is likewise finished.

After curing, the completed table 10 can readily be removed from form 118 by means of the jacks 126. That is to say, these jacks are located such that the extensible ends thereof lie beneath the individual support segments 58, 60. Accordingly, as shown in FIG. 8, operation of the jacks serves to lift the completed monolithic table 10 from the form 118. This is of course possible owing to the tapered nature of the table side margins as described previously.

I claim:

1. A unitary, monolithic, cast picnic table comprising a generally horizontal table section presenting a pair of side margins, a generally horizontal bench section located generally along and below each of the side margins of said table section, a central connecting section joining said table section and bench sections, and base structure permitting placement of the picnic table on a support surface.

2. The picnic table of claim 1, said picnic table being formed of concrete.

3. The picnic table of claim 1, said central section including a transverse segment interconnecting said bench sections, and a table support segment extending between said transverse segment and table section.

4. The picnic table of claim 3, said table support segment presenting a pair of opposed, inclined end walls extending upwardly from said transverse segment and located between said bench sections.

5. The picnic table of claim 4, said table support segment presenting a pair of opposed, inclined sidewalls extending upwardly from said transverse segment and located between said bench sections.

6. The picnic table of claim 1, said base structure comprising a pair of upright bench support segments respectively depending from said bench sections and presenting support surface-engaging undersides.

7. The picnic table of claim 6, each of said bench support sections presenting opposed, inclined end walls and opposed, inclined sidewalls.

8. The picnic table of claim 1, said table section and said bench sections each presenting tapered circumscribing walls.

9. The picnic table of claim 1, said bench sections being separate from one another.

10. The picnic table of claim 1, said table section and said bench sections being generally rectangular in plan configuration.

11. The picnic table of claim 1, there being free, unobstructed spaces between and below said bench sections and on opposite sides of said central connecting section.

* * * * *